US005711134A

United States Patent [19]

Tanaka

[11] Patent Number: 5,711,134

[45] Date of Patent: Jan. 27, 1998

[54] APPARATUS FOR FOLDING AND RECEIVING TAPE

[75] Inventor: Satoshi Tanaka, Toyama, Japan

[73] Assignee: YKK Corporation, Tokyo, Japan

[21] Appl. No.: 715,168

[22] Filed: Sep. 17, 1996

[30] Foreign Application Priority Data

Sep. 18, 1995 [JP] Japan ..... 7-238538

[51] Int. Cl.[6] ..... B65B 63/04

[52] U.S. Cl. ..... 53/117; 53/116; 53/527; 493/411; 493/414

[58] Field of Search ..... 53/116, 117, 527; 493/411, 412, 413, 414

[56] References Cited

U.S. PATENT DOCUMENTS

| | | | |
|---|---|---|---|
| 2,098,427 | 11/1937 | Menschner | 493/412 X |
| 3,083,437 | 4/1963 | Davis | 53/116 X |
| 3,351,992 | 11/1967 | Carter | 53/116 X |
| 3,378,898 | 4/1968 | Mendes | 53/116 X |
| 3,605,378 | 9/1971 | Read | 53/116 |
| 3,707,063 | 12/1972 | McIntyre | 53/116 |
| 3,917,250 | 11/1975 | Branick | 53/116 X |
| 4,097,039 | 6/1978 | Fischer | 493/413 X |
| 4,427,404 | 1/1984 | Yamada | 493/411 X |
| 4,846,454 | 7/1989 | Parkander | 493/412 X |
| 5,529,564 | 6/1996 | Hediger | 493/411 X |

*Primary Examiner*—Daniel Moon
*Attorney, Agent, or Firm*—Hill, Steadman & Simpson

[57] ABSTRACT

An apparatus for folding and receiving a continuous tape, which is being continuously fed, in a tape container, comprising: tape feed rollers disposed at a fixed position in a traveling path of the tape and driven for rotation to continuously feed the tape; a shooter disposed in a predetermined position downstream in a tape traveling direction of the tape feed rollers and having an upper end pivoted in such a manner that the shooter is pivotally movable with respect to the X axis and the Y axis; and first and second shooter-swinging means for pivotally moving a lower end of the shooter through a controllable width about the X axis and the Y axis.

5 Claims, 3 Drawing Sheets

APPARATUS FOR FOLDING AND RECEIVING TAPE

BACKGROUND OF THE INVENTION

1. Field of the Invention:

This invention relates to an apparatus for folding and receiving a continuous tape, such as a ribbon tape, a slide fastener tape and a slide fastener chain, orderly in a tape container.

2. Description of the Related Art:

Tape folding and receiving appratuses of this type are disclosed in, for example, Japanese Patent Laid-Open Publication No. Sho 62-8969 and Japanese Utility Model Laid-Open Publication No. Hei 4-31769. Each of these known apparatuses continuously feeds a continuous tape from above and toward a tape container, moving the tape back and forth in the tape feeding direction (the direction of the X axis) in the tape container, and moving the tape back and forth transversely (in the direction of the Y axis) through the entire width of the tape container. As a result, the tape is received as being is folded orderly as it is moved back and forth between front and rear ends in a longitudinal direction of the tape container.

The tape folding and receiving apparatus disclosed in Japanese Patent Lid-Open Publication No. Sho 62-8969 comprises tape feed rollers, which have a roll length equal to the width of the tape container and movable back and forth through the entire length of the tape container, a tape guide member cooperative with the tape feed rollers and movable back and forth along the entire length of the feed rollers axially thereof, and a pair of tape pressure members each pivotally movable into and out of the tape container for intermittently pressing upper side of successive turnover portions of the folded tape.

On the other hand, the tape folding and receiving apparatus disclosed in Japanese Utility Model Laid-Open Publication No. Hei 4-31769 comprises a pair of tape feed rollers supported on a free end of a bracket extending perpendicularly to a guide rod, a tubular shooter pivotally supported on the free end of the bracket downwardly of the tape feed rollers, and is moved back and forth through the entire length of the tape container while the bracket, together with the tape feed rollers and the shooter, are successively moved transversely of the tape at a predetermined pitch along the guide rod through the entire width of the tape container so that the tape is received in the container as being folded orderly.

However, according to Japanese Patent Laid-Open Publication No. Sho 62-8969, for moving the guide member, which is to be shifted in timed relation to the back-and-forth movement of the tape feed rollers, axially of the tape feed rollers at a predetermined pitch and for turning the guide member back at each end of the rollers, a very complex power transmission mechanism is absolutely necessary. Further, if the tape has a protuberance, such as a core yarn, along a longitudinal edge like a fastener tape, it is difficult to smoothly slide the tape axially of the feed rollers by the guide member so that this irregular sliding hinders stable receiving of the tape in the tape container, and it is also difficult to keep the original shape of the tape because the protuberance, such as the core yarn, of the tape is easily deformed flat as clamped between the tape feed rollers.

According to Japanese Utility Model Laid-Open Publication No. Hei 4-31769, since the tape feed rollers are disposed in a fixed position, it is possible to form in the circumferential surface of each of he rollers a guide groove along which the protuberance of the tape is to be guided and hence the shape of the protuberance would suffer no damage. However, in tis apparatus, since the bracket, together with the tape feed rollers and the shooter, is moved back and forth transversely through the entire width of the tape container while it is intermittently shifted transversely of he tape at a predetermined pitch along the guide rod, it is necessary to synchronize the feeding of the tape with the back-and-forth movement of the bracket. This requires a tape guide member whose motion must be controlled by a complex mechanism.

SUMMARY OF THE INVENTION

It is therefore an object of this invention to provide a very compact apparatus for folding and receiving a various kinds of continuous tape without using any complex mechanism, unlike the conventional tape folding and receiving apparatus.

According to this invention, the above object is accomplished by an apparatus for folding and receiving a continuous tape, which is being continuously fed, in a tape container, comprising: tape feed rollers disposed at a fixed position in a path of travel of the tape and driven for rotation to continuously feed the tape; a shooter disposed in a predetermined position downstream in a tape traveling direction of the tape feed rollers and having an upper end pivoted in such a manner that the shooter is pivotally movable with respect to the X axis and the Y axis; and first and second shooter-swinging means for pivotally moving a lower end of the shooter through an adjustable width about the X axis and the Y axis.

Preferably, the apparatus further includes a tape pressure member disposed adjacent to the tape container and controllably movable into and out of the tape container for intermittently pressing successive turnover portions of the folded tape on its upper side. Further, the apparatus additionally includes a drive source for the tape feed rollers, and pressure-member-start-time detecting means for detecting when the tape pressure member is to be actuated with respect to an extend of driving by the drive source.

Further, the tape feed rollers are a pair of mutually pressing rollers, one of the tape feed rollers having tape-transverse-movement restricting means for restricting transverse movement of the tape, at least one of the rollers having in its peripheral surface a ring-shape groove for guiding local protuberances of the tape surface. Still further, the first and second shooter-swinging means are disposed in parallel planes with each other and include first and second fork-shape members extending perpendicularly to each other and sandwiching the shooter on a side surface thereof, and first and second drive mechanisms for moving the first and second fork-shape members, respectively, back and forth in directions of the X axis and the Y axis in synchronism with the driving of the tape feed rollers. Furthermore, the tape pressure member is controllably driven by an actuator with respect to the motion of the second drive mechanism.

DETAILED DESCRIPTION OF THE PREFERRED EMBODIMENTS

Figure 1:
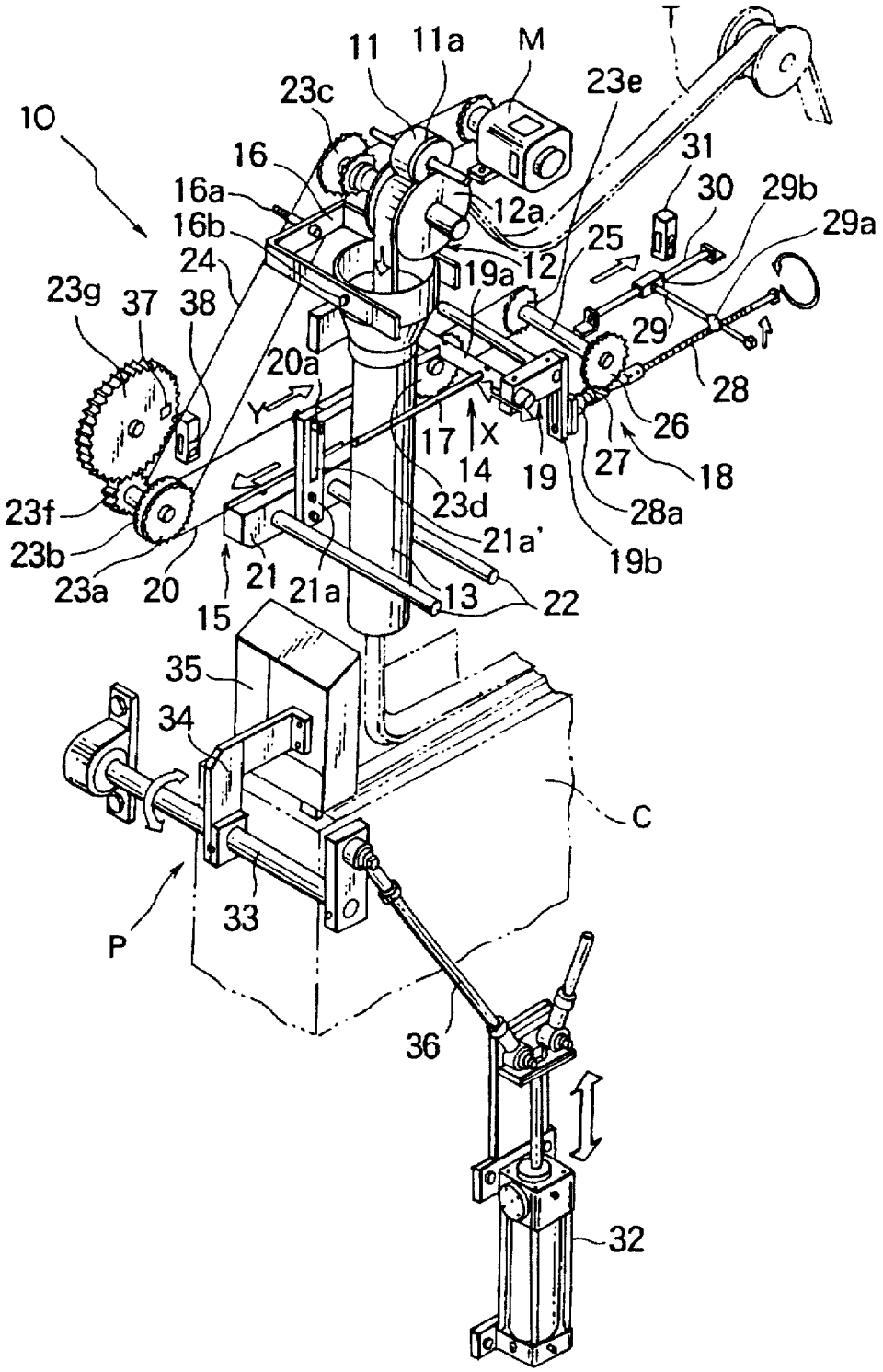
FIG. 1 is a fragmentary perspective view of a tape folding and receiving apparatus according to a typical embodiment of this invention.

Preferred embodiments of this invention will now be described in detail with reference to the accompanying drawings. FIG. 1 is a fragmentary perspective view of an apparatus, for folding and receiving a continuous slide fastener tape, according to a first embodiment of this invention. Since conventional mechanism can be adopted as mechanism except for those shown here as main parts, they are omitted from illustration in FIG. 1 and description here.

In FIG. 1, an apparatus 10 for folding a continuous tape, which is being fed continuously, and receiving the tape orderly in a folded form in a tape container C comprises a vertical pair of tape feed rollers, 11, 12 disposed at a fixed position and to be driven for rotation, a shooter 13 disposed at a predetermined position downwardly of the tape feed rollers 11, 12 in a tape traveling direction and having an upper end pivoted in such manner that the shooter 13 is pivotally movable with respect to the X axis and the Y axis, and first and second shooter-swinging mechanisms 14, 15 for pivotally moving a lower end of the shooter 13 through an adjustable width about the X axis and the Y axis.

In the illustrated example, the apparatus 10 further includes a tape pressure unit P disposed adjacent to the tape container C and having a pair of tape pressure members 35 movable into and out of the tape container C, and pressure-member-start-time detecting means 25–30 connected to an electric motor M, which serves as a drive source of the tape feed rollers 11, 12, for detecting a timing the individual tape pressure member 35 is to be started with respect to an extent of driving of the tape feed rollers 11, 12 by the motor M.

The lower feed roller 12 is driven at a predetermined controlled speed by the motor M via a chain, while the upper feed roller 11 is a freely movable roller pressed against the lower feed roller 12 via the fastener tape T by a predetermined pressure. In the illustrated example, the upper feed roller 11 has in its circumferential surface at one axial end a ring-shape guide groove 11*a* for receiving a beaded edge or core yarn of the fastener tape T, and the lower feed roller 12 has at each end a flange 12*a* which serves as tape-transverse-movement restricting means for restricting transverse movement of the fastener tape T.

The shooter 13 is in the form of a tube with an upper end opening disposed immediately under the upper and lower feed rollers 11, 12. The shooter 13 has an upper end pivotally supported by two pivots 16*a*, 16*b* via a generally C-shape frame 16 for pivotal movement about the X axis which extends transversely of the tape T and about the Y axis which extends in the tape feeding direction. The shooter 13 is pivotally moved in he direction of the X axis and in the direction of the Y axis about the pivots 16*b*, 16*a* by the first and second shooter-swinging mechanisms 14, 15.

The first shooter-swinging mechanism 14 has a first bifurcated for fork-shape member 17 to be moved at a predetermined pitch in the direction of the X axis, namely, transversely of the fastener tape T and back and for the through the substantially entire width of the tape container C by a drive unit 18 which serves as a first drive mechanism. The first fork-shape member 17 sandwiches the upper portion of the shooter 13 and is secured to a transverse lever 19*a* a base of which constitutes a part of a frame 19 having generally C-shape ends and to be controllably driven, together with the frame 19, in the direction of the X axis by the drive unit 18.

The second shooter-swinging mechanism 15 includes a horizontal pin 20*a* projecting from a first endless chain 20 which serves as a second drive mechanism to be driven for one-way rotation, a block 21 having an engaging member 21*a* engaging the pin 20*a* and movable back and forth through the substantially entire length of the tape container C in the direction of the Y axis, namely, in the tape feeding direction along a non-illustrated guide rail while the chain 20 makes one rotation, and a second bifurcated or fork-shape member 22 projecting in the direction of X axis from the block 21. The second fork-shape member 22 sandwiches a lower portion of the shooter 13. The engaging member 21*a* has a vertically elongated slot 21*a*' in which the pin 20*a* is engaged.

The first endless chain 20 is connected at one end to a first chain wheel 23*a* and is operatively connected with a third chain wheel 23*c* secured to the shaft end of the lower feed roller 12 by a second endless chain 24 via a second chain wheel 23*b* mounted on a common shaft with the first chain wheel 23*a*, so that the first endless chain 20 is driven for rotation in synchronism at a predetermined ratio with the driving of the motor M. The other end of the first endless chain 20 is connected to a fourth chain wheel 23*d*. The fourth chain wheel 23*d* is operatively connected to a firth chain wheel 23*e* secured to one end of a shaft 25 rotatably supported by a non-illustrated frame via a chain wheel train. To the other end of the shaft 25, a worm gear 26 is secured.

A worm 27 meshing the worm gear 26 is mounted on one end of a bolt 28 rotatably supported by a non-illustrated frame. Mounted on the same end of the bolt 28 a cam 28*a* engaging a cam follower 19*b* hanging from part of the C-shape frame 19. As the motor M is driven for rotation at a predetermined rotational speed, the bolt 28 keeps rotation at a predetermined ratio so that the cam 28*a* is rotated to move the first fork-shape member 17 back and for the in the direction of the X axis via the cam follower 19*b*. In this embodiment, the first shooter-swinging mechanism 14 is controllably driven by a drive system that is constituted by the worm 27, the cam 28*a*, and the cam follower 19*b*, which are operated in response to the rotation of the motor M.

An operating lever 29 extends perpendicularly to the bolt 28. An engaging piece 29*a* is secured to the operating lever 29 to engage with a screw portion of the bolt 28. A sliding piece 29*b* secured to one end of the operating lever 29 is slidably attached to a sliding-piece guide rod 30 fixed to a non-illustrated frame. Further, a detector 31 for detecting a limit position of sliding of the sliding piece 29*b* is disposed near one end of the sliding-piece guide rod 30. In this embodiment, the detector 31 is a photoelectric tube. Alternatively, the detector 31 may be any other form such as limit switch.

A detection signal from the detector 31 is transmitted as a start signal to an air cylinder 32, which serves as an actuator and is a drive source for the tape pressure unit P, via a non-illustrated controller. The tape pressure unit P is controllably moved into and out of the tape container C by the action of the air cylinder 32. The tape pressure unit P includes the pair of tape pressure member 35 each fixed, via an L-shape lever 34, to one end of each of two rotating rods 33 horizontally mounted on opposite ends of a non-illustrated support base of the tape container C, and a rod end of the air cylinder 32 is eccentrically connected to one end of the rotating rod 33 via a link 36. Accordingly, upon actuation of the air cylinder 32, the tape pressure unit P renders the tape pressure member 35 to pivotally move by 90° via the rotating rod 33, whereupon the turnover portion of the fastener tape T to be received in the tape container C is intermittently pressed a predetermined number of times from the upper side based on a detection signal that is generated by a reflection tape piece 37 and a photoelectric tube 38.

The action of the air cylinder 32 is controlled based on a timing signal that is detected with respect to the rotation of the first chain wheel 23*a*. According to the embodiment of FIG. 1, the reflection tape piece 37 is glued to a peripheral edge of a second gear 23*g* meshing a first gear 23*f*, at a predetermined gear ratio, which is mounted on one end of the shaft of the first chain wheel 23*a*, so that the air cylinder 32 is operated by a detection signal issued from the photoelectric tube 38, which is disposed confronting the peripheral edge of the second gear 23*f*, upon receipt of light reflected on the reflection tape piece 37.

The second gear 23*g* is exchangeable with another according to the hardness of the fastener tape T so that the hear ratio with respect to the first gear 23*of* is changed to a desired new value. For example, if the fastener tape T is rigid, it is difficult to keep the turnover portions of the fastener tape T in a folded form i the tape container C; in such event, the gear ratio may be changed so as to actuate the tape pressure member 35 every time the fastener tape T is folded. To the contrary, if the faster tape T is very soft, it is easy to keep the turnover portions of the tape in a folded form in the tape container C; then the gear ratio may be changed so as to actuate the tape pressure member 35 every several times the fastener tape T is successively folded.

Figure 2:
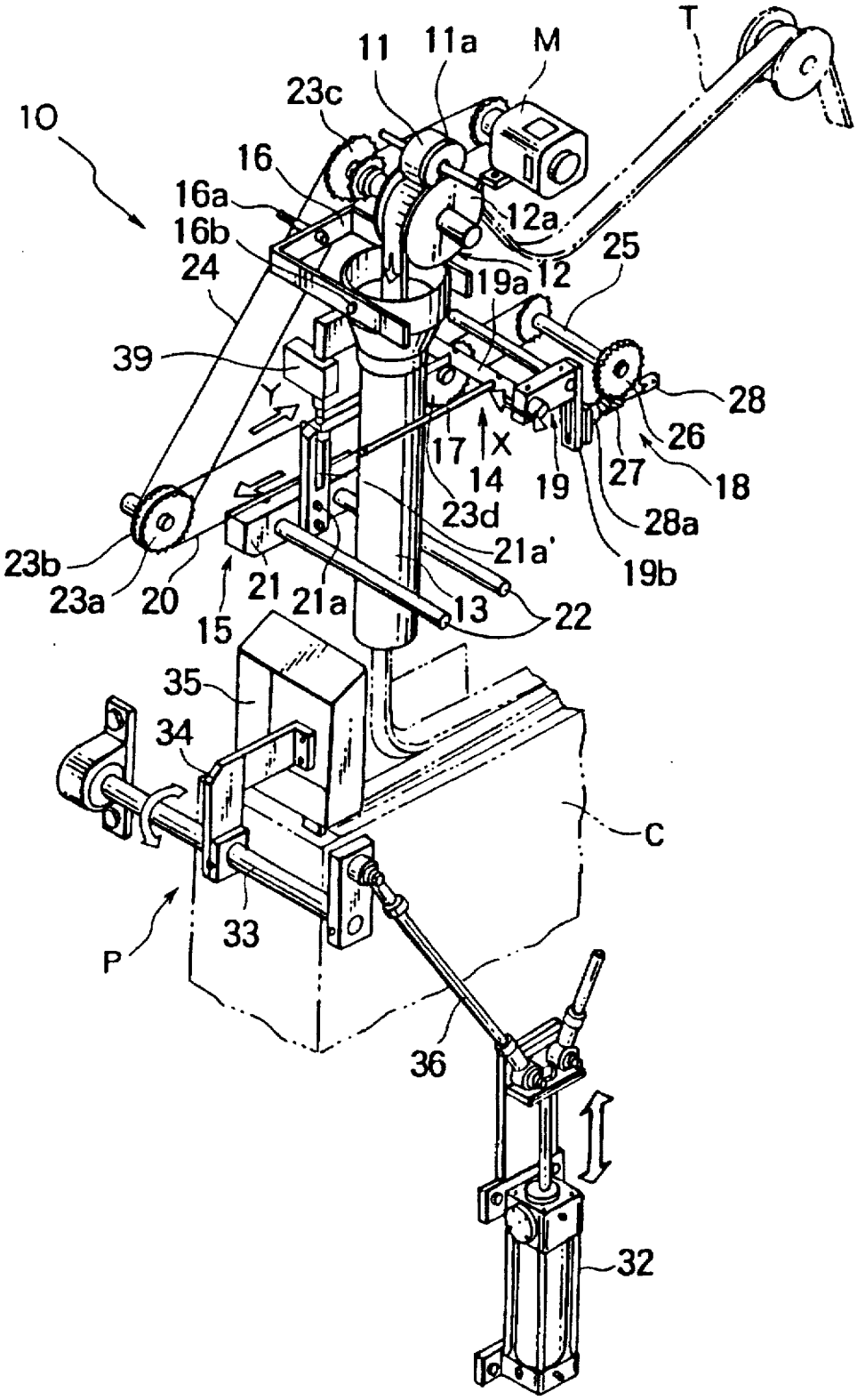
FIG. 2 is a fragmentary perspective view similar to FIG. 1, showing a modified folding and receiving apparatus according to another embodiment of the invention.
Figure 3:
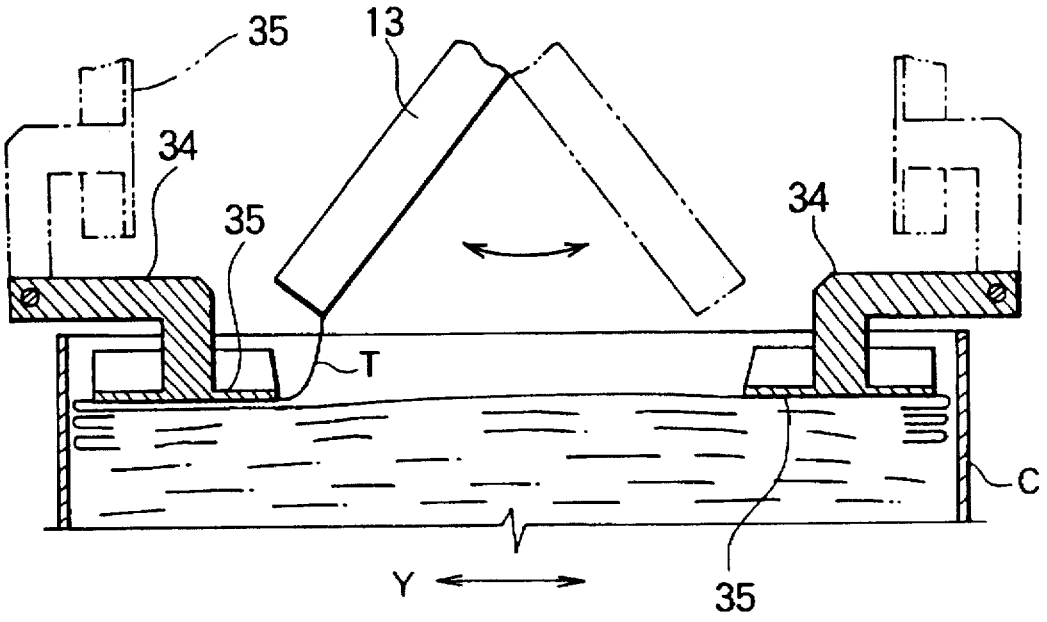
FIG. 3 is a cross-sectional view showing the manner in which successive turnover portions of a folded tape are intermittently pressed by tape pressure members of the apparatus.

FIG. 2 shows a second embodiment in which a limit switch 39 is substituted for the reflection tape piece 37 and the photoelectric tube 38. The limit switch 39 is disposed upwardly of and adjacent to the traveling path of the first endless chain 20 in confronting relation to a tapered upper surface of the engaging member 21*a*.

According to the tape folding and receiving apparatus 10 of this invention, the fastener tape T is continuously fed to the upper portion of the tape container C by the upper and lower feed rollers 11, 12. At that time, since the core yarn extending along one longitudinal edge of the fastener tape T is received and guided by the guide groove 11*a* of the upper tape feed roller 11, it is free from being deformed flat by the upper and lower tape feed rollers 11, 12. The fastener tape T is thus continuously fed by the tape feed rollers 11, 12, and introduced into the shooter 13.

Figure 4:
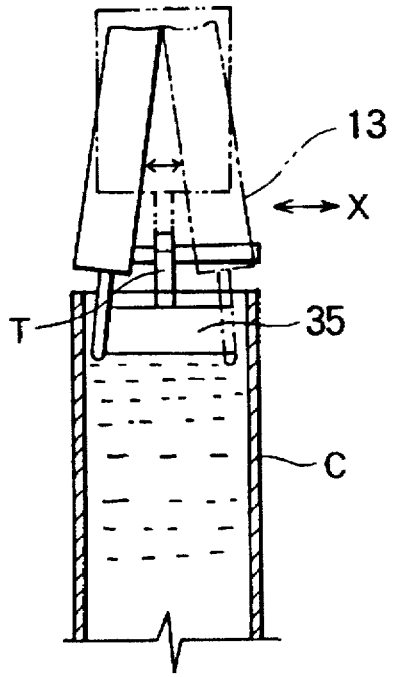
FIG. 4 is a cross-sectional view showing the manner in which the tape is shifted transversely of itself.

In accordance with the operation speed of the tape folding and receiving apparatus 10, the transverse lever 19*a* is moved in the direction of the X axis via the worm 27, the cam 28*a* and the cam follower 19*b* to move the shooter 13 back and forth along a predetermined stroke transversely of the tape container C by the first fork-shape member 17 (FIG. 4). At the same time, the block 21 engaging the pin 20*a* of the first endless chain 20 rotating in response to the driving of the motor M is moved back and forth along a predetermined stroke longitudinally of the tape container C to swing the shooter 13 in the direction of the Y axis by the second fork-shape member 22 (FIG. as). At that time, since the position from which the fastener tape T is introduced into the shooter 13 is fixed, the fastener tape T is introduced into the shooter 13 smoothly without any damage to the core yarn. And since the shooter 13 is pivotally moved in the direction of the X axis and in the direction of the Y axis, the fastener tape T is progressively received in the tape container C as it is folded orderly in regular distances.

For receiving the fastener tape T in a further orderly folded form, the operation of the air cylinder 32 is started upon receipt of a start signal from the detector 31 when the fastener tape T is repeatedly folded in the tape container C to reach a predetermined value, and thereafter the air cylinder 32 is operated intermittently every time it receives an operating signal from the photoelectric tube 38 or the limit switch 39, thereby swinging the tape pressure unit P intermittently at a predetermined timing. As a result, the turnover portions of the fastener tape T are pressed from the upper side by the tape pressure unit P as shown in FIG. 2 so that the fastener tape T is prevented from being drawn by the shooter 13.

As the tape folding and receiving apparatus 10 of this invention is started, the fastener tape T is received in an orderly folded form in the tape container C. With continued folding and receiving operation, the fifth chain wheel 23*e* continues rotating to revolve the bolt 28 via the worm gear 26 and the worm 27 so that the sliding piece 29*b* of the operating lever 29 is moved as guided by the guide rod 30. The detection signal of the sliding piece 29*b* by the photoelectric tube 31 may be used also for stopping the operation of the tape folding and receiving apparatus 10. In other words, the ratio of then umber of rotation of the bolts 28 to that of the motor M is previously set according to the quantity of operation of the tape folding and receiving apparatus 10 to operate a non-illustrated timer or counter based on the detection by the detector 31 so that the apparatus 10 is automatically stopped after the lapse of a predetermined time or until the number of rotations of the motor M reaches a predetermined value. To start the apparatus 10, the end of the operating lever 29 is raised to bring the engaging piece 29*a* away from the bolt 28, and the sliding piece 29*b* is moved to the start position along the guide rod 30, thus bringing the engaging piece 29*a* in engagement with the bolt 28 at the start position.

As is apparent from the foregoing description, according to the tape folding and receiving apparatus 10 of this invention, partly since the tape feed rollers 11, 12 serves also as the tape guide member and partly since they are disposed in a fixed position, it is possible to provide at least one of the tape feed rollers 11, 12 a groove 11*a* for receiving and guiding a protuberance bulging on the tape surface so that such thick tape portion is prevented from being deformed flat by the rollers 11, 12 while the tape T is being fed. Further, since the shooter 13 having its upper and opening immediately downstream of the tape feed rollers 11, 12 is pivotally supported at its upper end opening so that the lower end opening is pivotally moved back and forth through a predetermined width in the direction of the X axis and in the direction of the Y axis, it is possible to receive the tape T in an orderly folded form in the tape container C.

Further, in one example in which the tape pressure unit P disposed near the tape container C for temporarily pressing the turnover portions of the tape T is started after a predetermined quantity of the tape T has been received in the container C and is actuated in synchronism with the swinging movement of the shooter 13, it is possible to receive the tape T in a more orderly folded form. Furthermore, in another example in which the pressure-member-start-time detector 31 is used also for stopping the operation of the tape folding and receiving apparatus 10, it is possible to stop the tape folding and receiving apparatus 10 of this invention automatically when the quantity of operation reaches a predetermined value.

What is claimed is:

1. An apparatus for folding and receiving a continuous tape, which is being continuously fed, in a tape container, comprising:

(a) tape feed rollers disposed at a fixed position in a path of travel of the tape and driven for rotation to continuously feed the tape;

(b) a shooter disposed in a predetermined position downstream in a tape traveling direction of said tape feed rollers and having an upper end and a lower end, said shooter pivotally movable about said upper end;

(c) first and second shooter-swinging means for pivotally moving said lower end of said shooter in a first direction and a second direction generally perpendicular to said first direction; and (d) wherein said first and second shooter-swinging means are disposed in parallel planes with each other and include first and second fork-shape members extending perpendicularly to each other and sandwiching said shooter on a side surface thereof, and first and second drive mechanisms for moving said first and second fork-shape members, respectively, back and forth in said first and second directions coordinated with said tape feed rollers to evenly fill said container.

2. An apparatus according to claim 1, wherein said tape feed rollers are a pair of mutually pressing rollers, one of said tape feed rollers having tape-traverse-movement restricting means for restricting traverse movement of said continuous tape, at least one of said rollers having a circumferential ring-shape groove for receiving and guiding therein protuberances extending from a surface of said continuous tape.

3. An apparatus according to claim 1, further including a tape pressure member disposed adjacent to said tape container and controllably movable into and out of said tape container for intermittently pressing successive turnover portions of said continuous tape.

4. An apparatus according to claim 3, further including a drive source for said tape feed rollers, and pressure-member-start-time detecting means for detecting when said tape pressure member is to be actuated with respect to an extent of driving by said drive source.

5. An apparatus according to claim 3, wherein said tape pressure member is controllably driven by an actuator with respect to the motion of one of said shooter-swinging means.

* * * * *